US007407260B2

(12) United States Patent
Reinten

(10) Patent No.: US 7,407,260 B2
(45) Date of Patent: Aug. 5, 2008

(54) PRINTER DEVICE

(75) Inventor: Hans Reinten, Velden (NL)

(73) Assignee: Oce-Technologies B.V., Venlo (NL)

( * ) Notice: Subject to any disclaimer, the term of this patent is extended or adjusted under 35 U.S.C. 154(b) by 255 days.

(21) Appl. No.: 11/322,386

(22) Filed: Jan. 3, 2006

(65) Prior Publication Data

US 2006/0146084 A1 Jul. 6, 2006

(30) Foreign Application Priority Data

Jan. 4, 2005 (EP) ..... 05100023

(51) Int. Cl.
*B41J 2/15* (2006.01)

(52) U.S. Cl. ..... 347/41

(58) Field of Classification Search ..... 347/41, 347/22–36

See application file for complete search history.

(56) References Cited

U.S. PATENT DOCUMENTS 5,949,450 A 9/1999 Elley et al.

2004/0207684 A1* 10/2004 Plymale et al. ..... 347/33

FOREIGN PATENT DOCUMENTS

EP 1 228 881 A2 8/2002

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

A scanning type printing device is capable of operating in a multiple printing stage mode. When operating in a multiple printing stage mode, this printing device is controlled such upon receipt of a delay signal, further printing is executed, but only the strip of the image-receiving member, whereon printing is in progress until the image portion associated with that strip is completely printed. This is done in order to overcome or at least reduce gloss variations in a printed image when printing in progress is temporarily interrupted.

12 Claims, 5 Drawing Sheets

| | | | |
|---|---|---|---|
| 1 | 1 | 1 | 1 |
| 1 | 1 | 1 | 2 |
| 1 | 2 | 2 | 2 |
| 2 | 2 | 2 | 2 |

PRINTER DEVICE

CROSS-REFERENCE TO RELATED APPLICATIONS

This nonprovisional application claims priority under 35 U.S.C. § 119(a) on European Patent Application No. 05100023.0, filed on Jan. 4, 2005, the entirety of which is incorporated herein by reference.

BACKGROUND OF THE INVENTION

1. Field of the Invention

The present invention is related to a printing device such as a printing or copying system employing print heads containing discharging elements, e.g. nozzles, for image-wise forming dots of a marking substance on an image-receiving member, where the marking substance is in fluid form when discharged. Examples of such printing devices are inkjet printers and toner-jet printers. Hereinafter reference will be made to inkjet printers.

2. Description of Background Art

Print heads employed in inkjet printers and the like usually each contain a plurality of nozzles arranged in (an) array(s). The nozzles usually are placed substantially equidistant. The distance between two contiguous nozzles defines the nozzle pitch. In operation, the nozzles are controlled to image-wise discharge fluid droplets of a marking substance on an image-receiving member. When the printer is of the scanning type, the print heads are moveable in reciprocation across the image-receiving member, i.e. the main scanning direction. In such printers, the print heads are typically aligned in the sub scanning direction perpendicular to the main scanning direction. In a traverse of the print heads across the image-receiving member a matrix of image dots of a marking substance, corresponding to a part of an original image is formed on the image-receiving member by image-wise activating nozzles of the print heads. The printed matrix is generally referred to as a print swath, while the dimension of this matrix in the sub scanning direction is referred to as the swath width. After a first traverse, when a part of the image is completed, the image-receiving member is displaced relative to the print heads in the sub-scanning direction enabling printing of a subsequent part of the image. When this displacement step is chosen equal to a swath width, an image can be printed in multiple non-overlapping swaths. However, image quality may be improved by employing printing devices enabling the use of multiple printing stages, hence printed swaths are at least partially overlapping. In the background art, two main categories of such printing devices can be distinguished, i.e. so-called "interlace systems" and "multi-pass systems".

In an interlace system, the print head contains N nozzles, which are arranged in (a) linear array(s) such that the nozzle pitch is an integer multiple of the printing pitch. Multiple printing stages, or so-called interlacing printing steps, are required to generate a complete image or image part. The print head and the image-receiving member are controlled such that in M printing stages, M being defined here as the nozzle pitch divided by the printing pitch, a complete image part is formed on the image-receiving member. After each printing stage, the image-receiving member is displaced over a distance of M times the printing pitch. Such a system is of particular interest because it achieves a higher print resolution with a limited nozzle resolution.

In a "multi-pass system", the print head is controlled such that only the nozzles corresponding to selected pixels of the image to be reproduced are image-wise activated. As a result, an incomplete matrix of image dots is formed in a single printing stage or pass, i.e. one traverse of the print heads across the image-receiving member. Multiple passes are required to complete the matrix of image dots. The image-receiving member may be displaced in the sub scanning direction in-between two passes.

In practice the majority of print jobs is executed in such multiple printing stage mode on a scanning type bidirectional printing system, i.e. a printing system capable of printing on the image-receiving member in reciprocation in the main scanning direction.

Such systems, which may be "interlace systems" and "multi-pass systems" as well as combinations thereof, are known to be sensitive to gloss variations. Gloss variations can occur when at least a part of the image dots of a marking substance of the same or a different process color are deposited in multiple printing stages in superimposition or at least partially overlapping and when the drying time of the image dots printed on the image-receiving member interacts with the time period required to render all pixels of an image part, i.e. the time period required to complete a sequence of printing stages defined by the print mask. This is particularly the case when, while printing is in progress, a delay signal is generated which causes the printer to interrupt printing immediately or after completion of the printing stage in progress. In any case, printing of the subsequent printing stages is delayed until the cause of the delay is resolved and/or a resume signal is generated. This is observed to cause gloss banding on the print in progress.

SUMMARY OF THE INVENTION

Thus, it is an object of an embodiment of the invention to control a scanning type printing system when operating in a multiple printing stage mode such as to overcome or at least reduce gloss variations in a printed image when printing in progress is temporarily interrupted upon receipt of a delay signal.

It is a further object of an embodiment of the invention to control the print heads and the image-receiving member displacement device of a scanning type printing system such that, particularly when operating in a multiple printing stage mode, at each location on the image-receiving member in the sub-scanning direction, about the same time intervals are used between the time of deposition of the respective image dots, which when deposited are in superimposition or at least partially overlapping.

To meet these objects, a printing device for printing images on an image-receiving member in a sequence of printing stages includes a control that controls, in an operative state of the printer, responsive to said delay signal, the print head and the displacement device so that further printing is executed only during the stroke whereon printing is in progress until all printing stages of the sequence are completed for said stroke. Upon receipt of a delay signal, printing is continued on incompletely printed strokes until these are completed. Therefore, a huge time period between the remaining printing stages for such strokes whereon printing was in progress and the printing stages already executed during the strokes is avoided. The remaining printing stages are the printing stages not yet executed for these strokes. Hence, for these strokes, image dots deposited before receipt of the delay signal are completely dried when resuming printing and thus image dots associated with the remaining printing stages are deposited at least some of them in superimposition or at least partially overlapping with image dots already present on the image-receiving member. By completing the strokes upon which printing is in progress upon receipt of the delay signal, gloss banding caused by such delay is avoided.

The printing device may be provided with a device for generating a resume signal so that responsive to such resume signal printing may be resumed on a subsequent stroke of the image-receiving member contiguous to the printed strokes.

The printer may generate a delay or resume signal automatically. For instance, a delay signal may be generated because of a low ink level detection, or because a cleaning action of the print head is required, or another maintenance or service action is required. A resume signal may be generated after the requested intervention is completed. A delay signal or a resume signal may also be generated by user interaction. The image-receiving member may be an intermediate image carrying member or a print medium. The print medium can be in web or sheet form and may be composed of e.g. paper, cardboard, label stock, plastic or textile.

The so-called print mask contains the information about the number and sequence of printing stages and defines for each print head which discharging elements can be image-wise activated, or in other words contains the information defining for each printing stage which pixels will be rendered by which discharging elements such that when all printing stages are completed, all the pixels of the image concerned, or at least a part of such image, are rendered. A print mask is associated with a printing mode. Selecting a printing mode enables the user to exchange image quality for productivity and vice versa dependent on his requirements. By selecting a printing mode also the discharging elements on the print heads which may be effectively used for image-wise activation are determined as well as the displacement step in the sub scanning direction after each printing stage.

Gloss banding may even be further reduced by ensuring that the time intervals between the deposition of at least partially overlapping image dots, each associated with a particular printing stage, are about the same regardless of the position on the image-receiving member in the sub-scanning direction. Hence, in an embodiment of the present invention, the control means select for each said traverse of the print head in the main scanning direction an active portion of the plurality of discharging elements, each active portion of discharging elements being selected on the basis of the predetermined distance so that for substantially each position in the sub scanning direction on the part of the image-receiving member where the image is to be rendered, the traversing direction of the print head is the same for each first exposure to an active portion of the traversing print head. Each traverse of the print head in operative state results in a printed portion of an image on the image-receiving member formed by a pattern of image dots of marking substance. After each traverse the image-receiving member is displaced with respect to the print head in the sub scanning direction either by displacing the image-receiving member or by displacing the print head. When printing subsequent portions of an image, a repetitive sequence of printing stages and corresponding displacement steps is used, each displacement step being defined by the relative displacement between the print head and the image-receiving member over a predetermined distance between respective subsequent printing stages. In particular, each of the displacement steps may equal the same constant.

By selecting for each traverse of the print head an active portion thereof taking account of the displacement step between subsequent traverses, the present invention accomplishes that on substantially each position of the image-receiving member the traversing direction of the print head is the same for each first exposure to an active portion of the traversing print head. The advantage thereof is that in the sub-scanning direction there are no time interval differences between the time of deposition of image dots originating from different traverses even when printing is temporarily interrupted due to a delay signal. Hence no gloss variations will occur or they will be at least severely reduced. The selected active portion for a forward traverse may be different from the selected active portion for a backward traverse. In particular each active portion may selected such that the product of the number of discharging elements available in that active portion and the discharging element pitch is a non-zero integer multiple of the displacement distance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2*c* depicts, according to an embodiment of the present invention, for respective traverses of the print head/printing stages used, which portion of the print head will be used and how the receipt of a delay signal is dealt with;

FIG. 3*c* depicts, according to an embodiment of the present invention, for respective traverses of the print head/printing stages used, which portion of the print head will be used and how the receipt of a delay signal is dealt with.

DETAILED DESCRIPTION OF THE INVENTION

In relation to the appended drawings, the present invention is described in detail in the sequel. Several embodiments are disclosed. It is apparent however that a person skilled in the art can imagine several other equivalent embodiments or other ways of executing the present invention, the scope of the present invention being limited only by the terms of the appended claims.

Figure 1:
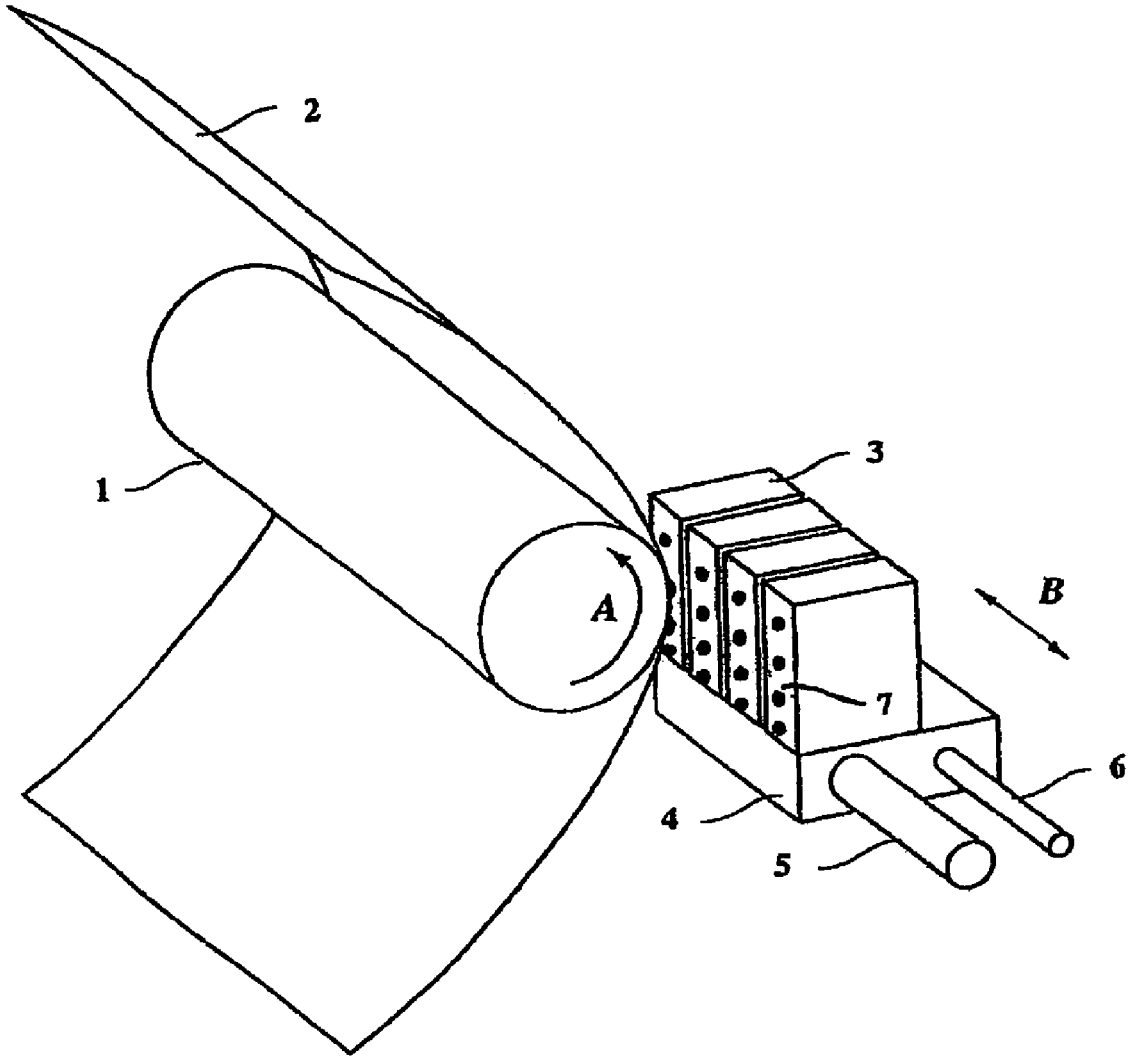
FIG. 1 depicts an example of an inkjet printer according to an embodiment of the present invention.

The printing device of FIG. 1 is a scanning bi-directional inkjet printer comprising a roller (1) for supporting an image-receiving member (2) and moving it along four print heads (3), each of a different process color. The roller is rotatable about its axis as indicated by arrow A. A scanning carriage (4) carries the four print heads and can be moved in reciprocation in the main scanning direction, i.e. the direction indicated by the double arrow B, parallel to the roller (1), such as to enable scanning of the image-receiving member in the main scanning direction. The image-receiving member can be a medium in web or in sheet form and may be composed of, e.g. paper, cardboard, label stock, plastic or textile. Alternately, the image-receiving member can also be an intermediate member, endless or not. Examples of endless members, which can be moved cyclically, are a belt or a drum. The carriage (4) is guided on rods (5) (6) and is driven by suitable means (not shown). Each print head (3) comprises a number of discharging elements (7) arranged in a single linear array parallel to the sub scanning direction. Four discharging elements (7) per print head (3) are depicted in the figure, however obviously in a practical embodiment typically several hundreds of discharging elements are provided per print head. Each discharging element is connected via an ink duct to an ink reservoir of a corresponding color. Each ink duct is provided with a device for activating the ink duct and an associated electrical drive circuit. For instance the ink duct may be activated thermally and/or piezoelectrically. When the ink duct is activated, an ink drop is discharged from the discharge element in the direction of the roller (1) and forms a dot of ink on the image-receiving member (2). The printer further comprises a controller (not shown), which controls the drive of the carriage, the print heads, the image-receiving member advancement, the ink supply, etc. The printer is arranged to automatically detect a maintenance condition and to generate a delay signal, which delays printing according to an embodiment of the present invention. The printer is also arranged to automatically detect the completion of the required intervention and will generate a resume signal such that printing can be resumed.

To enable printing a digital image is first formed. There are numerous ways to generate a digital image. For instance, scanning an original using a scanner can be used to create a digital image. A camera or a video camera can also be used to create digital still images. Besides digital images generated by a scanner or a camera, which are usually in a bitmap format or a compressed bitmap format also artificially created, e.g. by a computer program, digital images or documents may be sent to the printing device. The latter images can be in a vector format. The latter images can also be in a structured format including but not limited to a page description language (PDL) format and an extensible markup language (XML) format. Examples of a PDL format are PDF (Adobe), PostScript (Adobe), and PCL (Hewlett-Packard). The image processing system typically converts a digital image with known techniques into a series of bitmaps in the process colors of the printing device. Each bitmap is a raster representation of a separation image of a process color specifying for each pixel ("picture element") an image density value for said process color. An image composed of ink dots can be formed on the image-receiving member by image-wise activating the ink ducts in relation to the pattern(s) of image pixels.

EXAMPLE 1

A printing device as depicted in FIG. 1 is used to reproduce a digital image. Instead of using the print heads provided with four discharging elements each as in the figure, each print head is provided with 24 discharging elements, i.e. nozzles, arranged in a single linear array. The nozzles are positioned equidistant at a resolution of 300 npi (nozzles per inch). This means that the nozzle pitch or element pitch, being the distance between the centres of two adjacent nozzles, is about 85 μm.

Figures 2A, 2B:
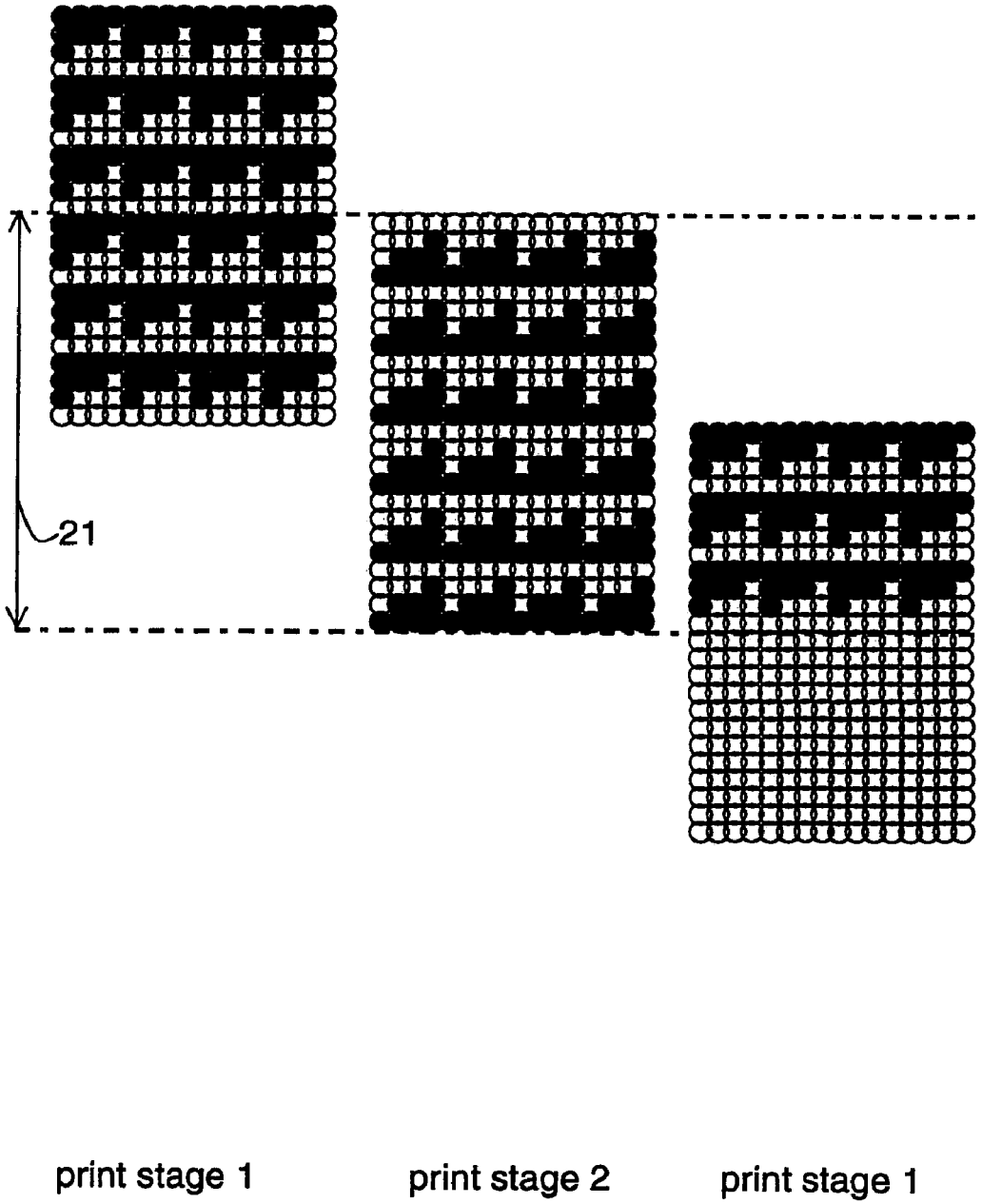
FIG. 2*a* depicts an example of a print mask defining two printing stages.
FIG. 2*b* depicts, according to an embodiment of the present invention, image dot patterns generated by a single print head assuming a full coverage image using all 24 nozzles of the print head and using the print mask of FIG. 2*a;*

Suppose the user selects a particular printing mode enabling reproduction of a digital image at a printing resolution of 300 dpi (dots per inch) in both the main scanning and the sub scanning directions, or in other words, the printing pitch, i.e. the distance between centers of two contiguous dots of ink both in the main scanning direction and in the sub scanning direction, is about 85 μm. In this printing mode, the print mask as depicted in FIG. 2*a* is used. In case the image is a multicolor image, the same print mask is used for each of the process colors. The print mask as depicted in FIG. 2*a* defines a "multi-pass" system with two printing stages. As depicted in FIG. 2*b*, in the first printing stage, a first portion of the image is printed by image-wise activating selected nozzles of the active portion of the print head. The image pattern resulting when activating all selected nozzles is indicated in FIG. 2*b* with black circles. In this case the active portion includes all 24 available nozzles. This first printing stage coincides with a forward traverse of the print heads across the image-receiving member, i.e. a traverse from the left to the right. Then, the image-receiving member is advanced over a predetermined constant distance of 12 times the printing pitch to enable printing of a second portion of the image by image-wise activating a different selection of nozzles of the same active portion. The image pattern resulting when activating all selected nozzles according to the second printing stage is indicated in FIG. 2*b*. This second printing stage coincides with a backward traverse of the print heads across the image-receiving member, i.e. a traverse from the right to the left. In a normal operation mode, when the image is not yet completed, the image-receiving member is again advanced over the same constant distance being 12 times the nozzle pitch. Thereafter, the above-described sequence of printing stages and image-receiving member advancing is repeated until the last portion of the image is completed.

Figure 2C:
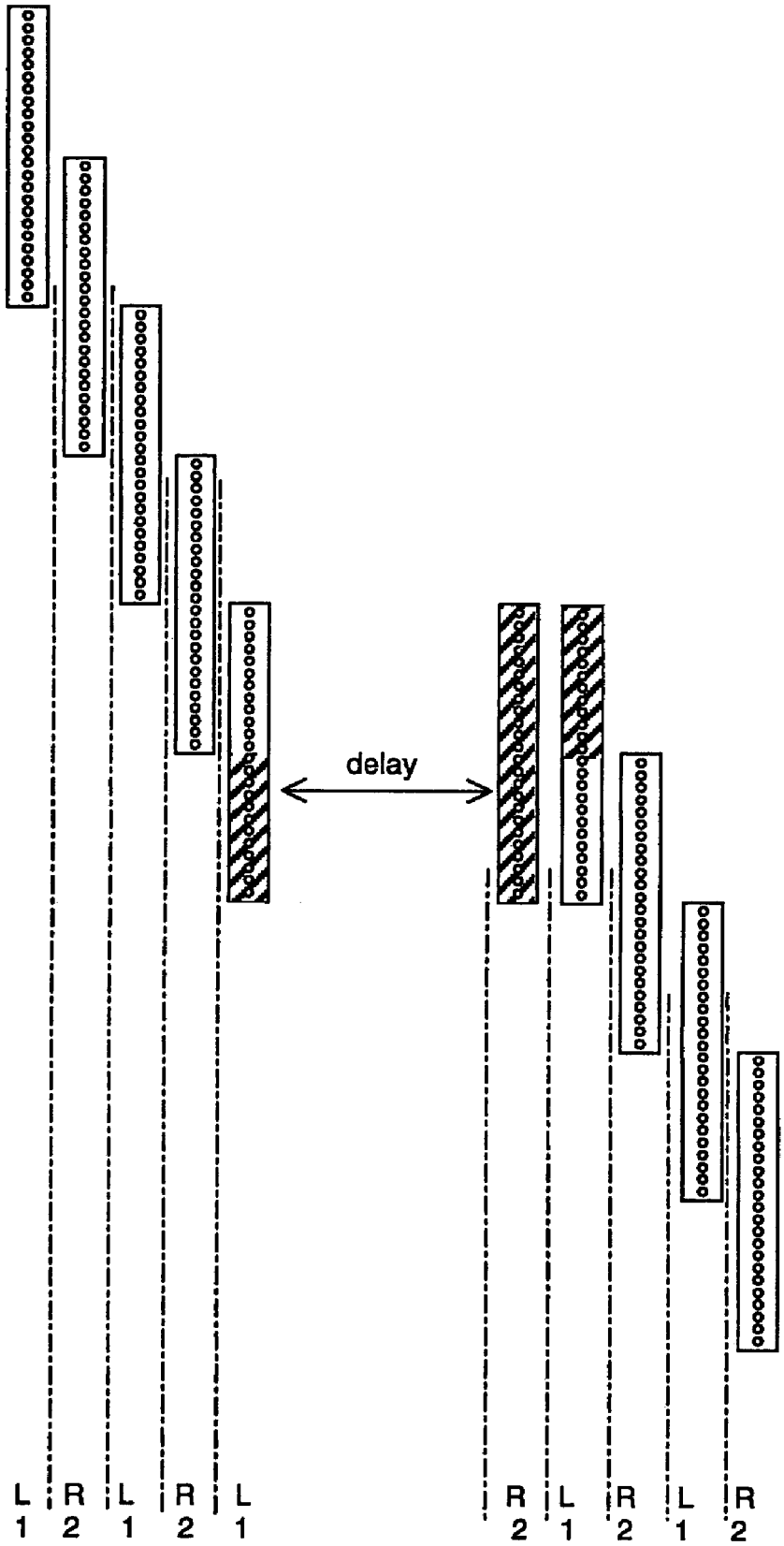

Suppose, however, that a delay signal is generated during execution of a second printing stage, i.e. during a backward traverse of the print head. As indicated in FIG. 2*b*, a delay signal is generated at the time printing is in progress on a stroke (21) of the image-receiving member. It is clear from FIG. 2*b* that even after finishing printing stage 2 this stroke is still printed incompletely. According to an embodiment of the present invention, upon receipt of the delay signal, printing on strokes of the image-receiving member on which printing is already started is progressed. However, printing on a subsequent stroke of the image-receiving member is not started. In this example, this means that printing on stroke (21) is progressed until all printing stages required to completely render the image portion associated with this stroke are completed. Thus, in order to complete the stroke (21), the print head is advanced over a distance of 12 times the printing pitch. Thereafter, printing stage 1 is executed using only the upper half of the nozzles. Further referring to FIG. 2*c*, as stroke (21) is completed now, printing is delayed until the required intervention is completed. When resuming printing, the printing process is recovered with the strokes left blank during finishing of printing process. One option is, as depicted in FIG. 2*c*, to advance the print head from the right to the left with all nozzles inactive. Thereafter, printing stage 1 is executed for the subsequent stroke using the complementary part of the print head, being the lower half of the nozzles. Thereafter, printing can proceed according to the print mask until the complete image is printed. Instead of advancing the print head from the right to the left with all nozzles inactive after the delay, another option (not shown) is immediately executing printing stage one for the subsequent stroke. In that case the print head is traversed from the right to the left using the complementary part of the print head, being the lower half of the nozzles. Thereafter printing can proceed according to the print mask until the complete image is printed

EXAMPLE 2

A printing device as depicted in FIG. 1 is used to reproduce a digital image. Instead of using the print heads provided with four discharging elements each as in the figure, each print head is provided with 12 discharging elements, i.e. nozzles, arranged in a single linear array. The nozzles are positioned equidistant at a resolution of 300 npi (nozzles per inch). This means that the nozzle pitch or element pitch, being the distance between the centres of two adjacent nozzles is about 85 μm.

Figure 3A:
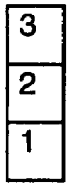
FIG. 3*a* depicts an example of a print mask defining three printing stages.
Figure 3B:
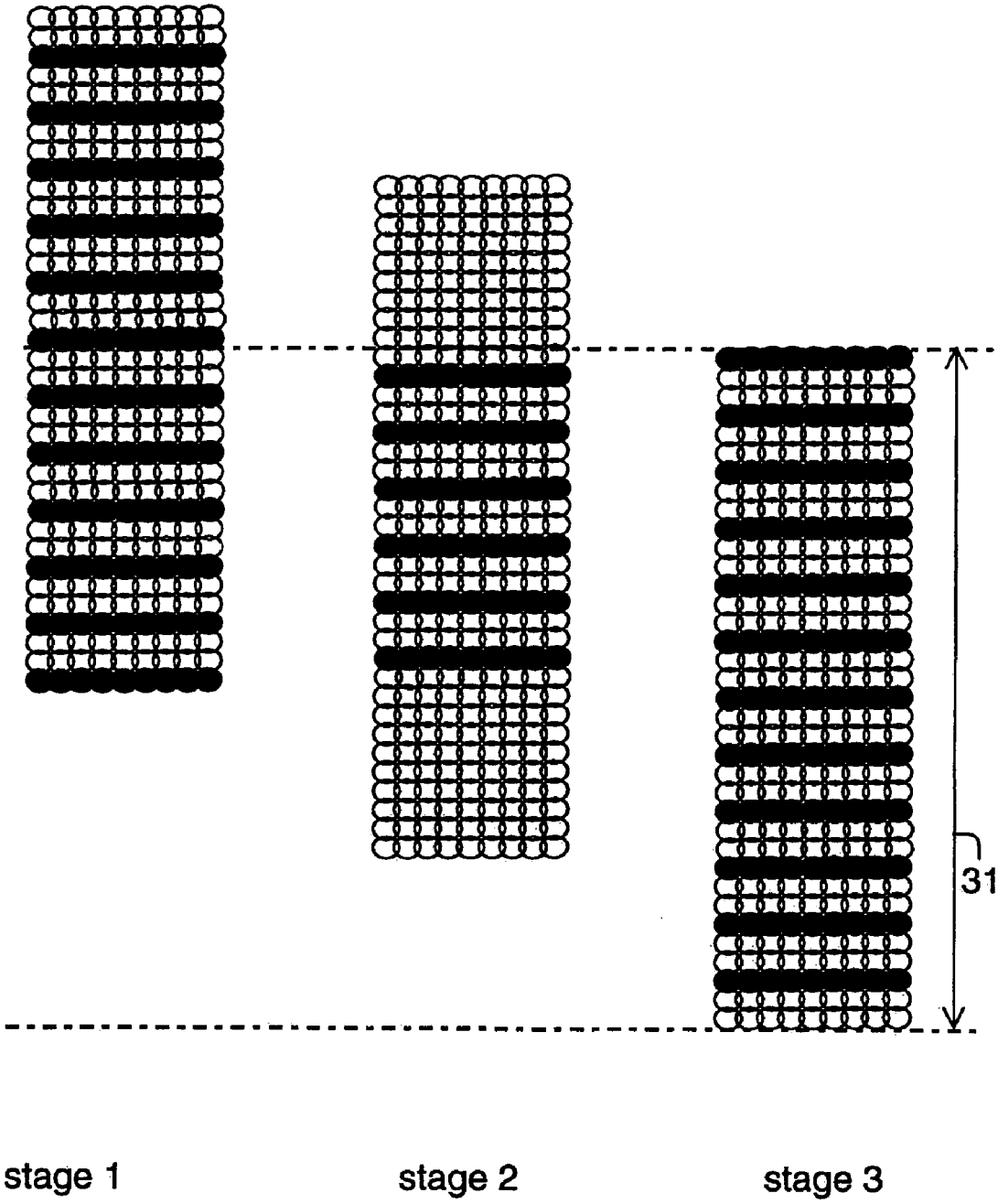
FIG. 3*b* depicts, according to an embodiment of the present invention, image dot patterns generated by a single print head assuming a full coverage image using in each traverse a selected active portion of the print head using the print mask of FIG. 3*a*.
Figure 3C:
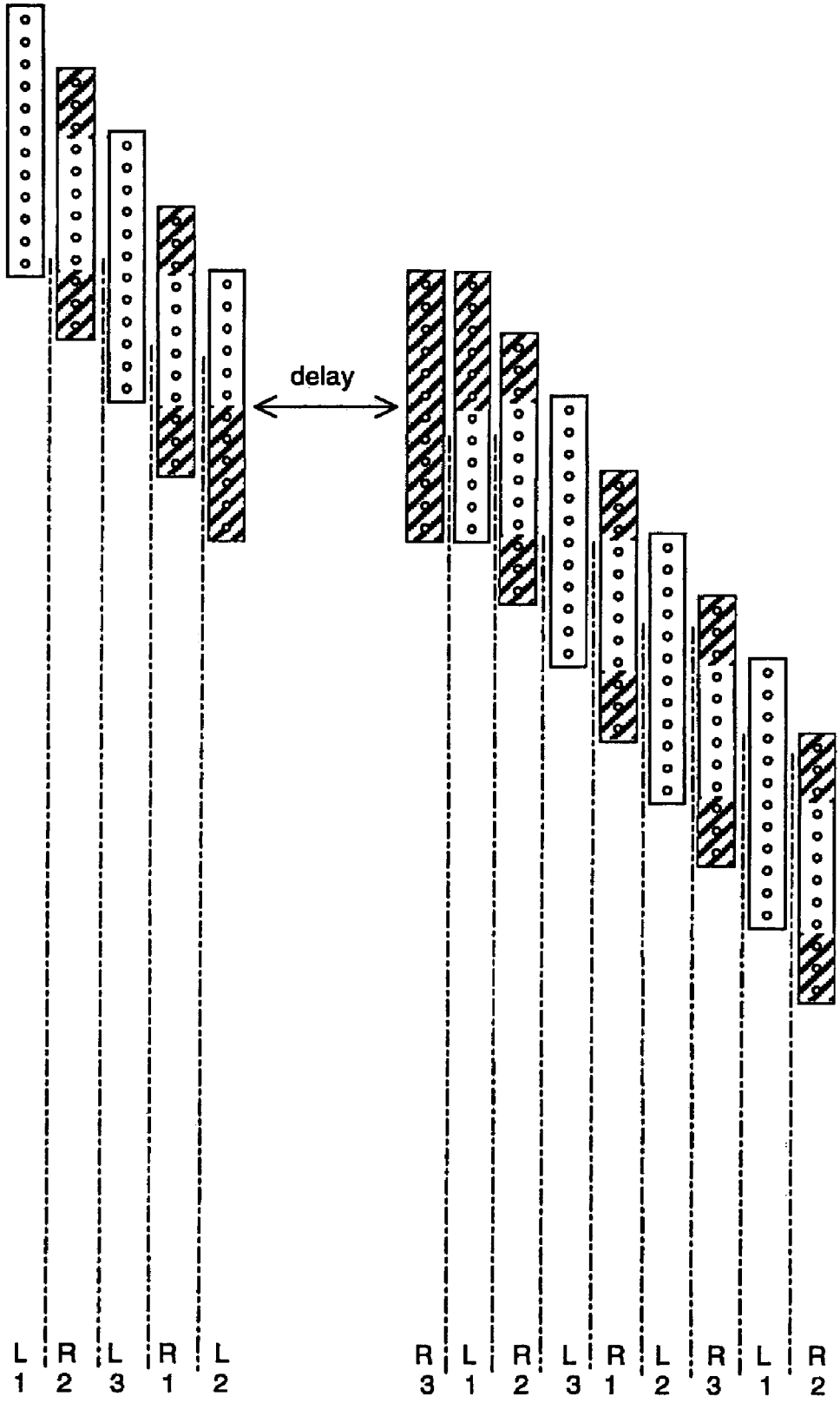

Suppose the user selects a particular printing mode enabling reproduction of a digital image at a printing resolution of 900 dpi (dots per inch) in both directions, or in other words, the printing pitch, i.e. the distance between the centers of two contiguous dots of ink both in the main scanning direction and in the sub scanning direction, is about 31 μm. To enable rendering of an image with a resolution higher than the nozzle resolution, the print mask associated with the selected printing mode as in FIG. 3*a* defines an interlacing system. The print mask defines a sequence of three printing stages required to completely render at least a part of the image. For each printing stage, i.e. for each traverse of a print head(s) in the main scanning direction, an active portion of the plurality of available discharging elements of the print head is selected. In particular, as also depicted in FIG. 3*c*, when a printing stage coincides with a traverse of the print head from the left to the right, the active portion includes all 12 available nozzles. When a printing stage coincides with a traverse of the print head from the right to the left, the active portion includes the six nozzles located in the middle of the print head, while the upper three nozzles as well as the lower three nozzles are part of the inactive portion.

In this example, the active portion in each forward traverse and the active portion in each backward traverse are selected such that the swath width of each portion of an image printed in the forward traverse is twice the swath width of each portion of an image printed in the backward traverse. When executing a first printing stage using the print mask as depicted in FIG. 3*a*, the resulting dot pattern when activating all selected nozzles is indicated in FIG. 3*b* with black circles. For instruction purposes, only the dots generated by a single print head are shown and a full coverage image is assumed. In practice, however, it is clear that images can be formed in the same way multi-color images can be formed by adequately timing both the driving of the respective print heads and the image-wise activation of the associated nozzles. Each nozzle image-wise forms a complete line of image dots of ink in the main scanning direction. In the sub scanning direction, only every third pixel is printed during the first printing stage. After the first printing stage is executed, the image-receiving member is advanced over a distance of 8 times the printing pitch. After the displacement step, the second printing stage is executed. In this second printing stage, i.e. a traverse from the right to the left, the active portion includes the 6 nozzles located in the middle of the print head, while the inactive portion includes both the lower and upper three nozzles. A dot pattern as schematically depicted in FIG. 3*b* is obtained. After the second printing stage is executed, the image-receiving member is again advanced over a distance of 8 times the printing pitch. In the third printing stage, in this case a traverse from left to right, under normal operating conditions, again the full print head is employed. Under normal operating conditions, when the image is not yet completed, the image-receiving member is advanced over a distance of 11 times the printing pitch. Thereafter, the above-described sequence of printing stages, being stages 1, 2 and 3, and corresponding image-receiving member advancement steps of 8, 8 and 11 printing pitches, is repeated until the image is completed.

As can be observed in FIG. 3*b*, the selection of the active portions in the forward and backward traverses respectively takes account of the image-receiving member displacement step so that for each position in the sub scanning direction on the part of the image-receiving member where the image is to be rendered, the traversing direction of the print head is the same for each first exposure to an active portion of the traversing print head.

Suppose, however, that a delay signal is generated during execution of a third printing stage, in this example during a forward traverse of the print head. As indicated in FIG. 3*b*, a delay signal is generated at the time printing is in progress on a stroke (31) of the image-receiving member. It is clear from FIG. 3*b* that even after finishing printing stage 3, this stroke is still printed incompletely. According to an embodiment of the present invention, upon receipt of the delay signal, printing on strokes of the image-receiving member on which printing is already started is progressed. However, printing on a subsequent stroke of the image-receiving member is not started. In this example, this means printing on stroke (31) is progressed until all printing stages required to completely render the image portion associated with this stroke are completed. Thus, in order to complete the stroke (31), the print head is advanced over a distance of 11 times the printing pitch. Then, with reference to FIG. 3*c*, printing stage 1 is executed using, in this case a traverse from the right to the left, the center half of the nozzles as an active portion of the print head. Subsequently, the print head is advanced over a distance of 8 times the printing pitch. Thereafter, printing stage 2 is executed. Normally, in this case a traverse from the left to the right, the active portion of the print head includes all nozzles. However, as printing is to be limited to stroke (31) only, only the upper half of the nozzles is image-wise activated. As stroke (31) is completed now, printing is delayed until the required intervention is completed.

When resuming printing, the printing process is recovered with the strokes left blank during finishing of the printing process. In particular, the print head is advanced from the right to the left with all nozzles inactive. Thereafter, printing stage 1 is executed for the subsequent stroke using the complementary part of the print head, being the lower half of the nozzles. Thereafter printing can proceed according to the print mask until the complete image is printed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing device for printing images on an image-receiving member in a sequence of printing stages, the printing device comprising:

at least one print head for printing in each printing stage a portion of an image on a strip of the image-receiving member, said at least one print head being displaceable in reciprocation across the image-receiving member in a main scanning direction and having a plurality of discharging elements for printing in each printing stage a portion of an image on a strip of the image-receiving member, each printing stage corresponding with a traverse of said at least one print head in an operative statein the main scanning direction;

a displacement device that establishes relative displacement between said at least one print head and the image-receiving member over a predetermined distance in a sub-scanning direction after each printing stage such that subsequently printed strips are at least partially overlapping;

a device that generates a delay signal; and a control that controls, in an operative state of the printer, responsive to said delay signal, said at least one print head and the displacement device so that further printing is executed only on a strip whereon printing is in progress upon receipt of the delay signal until all printing stages of the sequence are completed for said strip.

2. The printing deyice as recited in claim 1, further comprising a device that generates a resume signal so that, responsive to said resume signal, printing is resumed on a subsequent strip of the image-receiving member contiguous to the printed strips.

3. The printing device as recited in claim 1, wherein the delay signal is a maintenance request signal.

4. The printing device as recited in claim 2, wherein the delay signal is a maintenance request signal.

5. The printing device as recited in claim 1, wherein the delay signal is generated by operator interaction.

6. The printing device as recited in claim 2, wherein the delay signal is generated by operator ihteraction.

7. The printing device as recited in claim 1, Wherein, the control selects, for each said traverse of said at least one print head in the main scanning direction, an active portion of the plurality of discharging elements, each active portion of discharging elements being selected on the basis of the predetermined distance so that for substantially each position in the sub scanning direction on the part of the image-receiving member where the image is to be rendered, the traversing direction of said at least one print head is the same for each first exposure to an active portion of the traversing print head.

8. The printing device as recited in claim 7, wherein the selected active portion for a forward traverse is different from the selected active portion for a backward traverse.

9. The printing device as recited in claims 7, wherein, when printing subsequent portions of an image, a repetitive sequence of printing stages and corresponding displacemcnt steps is used, each displacement step being defined by the, relative displacement between said at least one print head and the image-receiving member over a predetermined distance between respective subsequent printing stages.

10. The printing device as recited in claims 8, wherein, when printing subsequent portions of an image, a repetitive sequence of printing stages and corresponding displacement steps is used, each displacement step being defined by the relative displacement between said at least one print head and the image-receiving member over a predetermined distance between respective subsequent printing stages.

11. The printing device as recited in claim 9, wherein each of the displacement steps equals the same constant.

12. The printing device as recited in claim 10, wherein each of the displacement steps equals thesame constant.

* * * * *